US005389501A

United States Patent [19]

Rogers et al.

[11] Patent Number: 5,389,501

[45] Date of Patent: Feb. 14, 1995

[54] METHOD OF FIXING A PHOTOGRAPHIC MATERIAL

[75] Inventors: David N. Rogers, Harrow; John R. Fyson, Hackney, both of United Kingdom

[73] Assignee: Eastman Kodak Company, Rochester, N.Y.

[21] Appl. No.: 83,815

[22] Filed: Jun. 28, 1993

[30] Foreign Application Priority Data

Jul. 4, 1992 [GB] United Kingdom ..... 9214273

[51] Int. Cl.[6] ..... G03C 5/38

[52] U.S. Cl. ..... 430/393; 430/455; 430/459

[58] Field of Search ..... 430/393, 455, 566, 459

[56] References Cited

U.S. PATENT DOCUMENTS

| | | | |
|---|---|---|---|
| 4,046,568 | 9/1977 | Greenwald | 430/455 |
| 4,304,847 | 12/1981 | Nakamura et al. | 430/455 |
| 4,387,154 | 6/1983 | Whitmore | 430/455 |
| 4,444,873 | 4/1984 | Ishikawa et al. | 430/455 |
| 4,458,010 | 7/1984 | Yamamuro et al. | 430/455 |
| 4,865,956 | 9/1989 | Harder et al. | 430/460 |
| 5,236,814 | 8/1993 | Kuse et al. | 430/455 |
| 5,275,923 | 1/1994 | Fyson | 430/455 |

FOREIGN PATENT DOCUMENTS

| | | |
|---|---|---|
| 0317950 | 11/1988 | European Pat. Off. . |
| 476434 | 3/1992 | European Pat. Off. . |

*Primary Examiner*—Hoa Van Le

*Attorney, Agent, or Firm*—Sarah Meeks Roberts

[57] ABSTRACT

A method of fixing a photographic element with a fixing solution containing less than 20% ammonium thiosulphate wherein the photographic element has incorporated therein a fix accelerator precursor which is a silver salt of an amino thiol having a solubility of less than 1 g/l (as silver ion) when held for 23° C. for 5 minutes in a colour developer solution at pH 10 having a sulphite concentration of 4.25 g/l and a bromide concentration of 1.2 g/l.

13 Claims, No Drawings

METHOD OF FIXING A PHOTOGRAPHIC MATERIAL

This invention relates to a method of fixing a photographic material.

During the processing of a photographic material, and after image formation, it is usual to remove unexposed silver halide from the material as it would otherwise cause the image to darken spontaneously. The process for removing it is called fixing and is done by treating the photographic material with a fixer. It is well known to use fixers based on ammonium thiosulphate as they allow a shorter fixing time than, say, sodium thiosulphate (hypo).

Ammonium ions are less acceptable than sodium ions in the environment thus the disposal of a sodium thiosulphate fixer effluent is easier than provided by an ammonium thiosulphate fixer. However, the use of sodium thiosulphate fixer has been found to be unacceptable because it takes too long a time to complete fixation.

The present invention seeks to provide a way of using sodium thiosulphate fixers without sacrificing fixing speed.

European Patent Application 0 317 950 A describes the use of the silver salts of a solubilised amino thiols as bleach accelerator precursors in photographic elements which are bleached in a bleach or bleach-fix bath. There is no disclosure of the use of these compounds as anything other than a bleach accelerator.

According to the present invention there is provided a method of fixing a photographic element with a fixer solution in which the fixing agent comprises less than 20% ammonium thiosulphate characterised in that the photographic element has incorporated therein a fix accelerator precursor which is a silver salt of an amino thiol having a solubility of less than 1 g/l (as silver ion) when held for 23° C. for 5 minutes in a colour developer solution at pH 10 having a sulphite concentration of 4.25 g/l and a bromide concentration of 1.2 g/l.

Preferably the amino thiol has a solubility of from 0.1 to 1 g/l (as silver ion).

Preferably the silver salt of the amino thiol has the general formula:

$$Ag—S—R^1—NR^2R^3$$

wherein $R^1$ is an alkylene group of 1–20 carbon atoms, and $R^2$ and $R^3$ are each hydrogen or an alkyl group of 1–4 carbon atoms which may be interrupted by a hetero atom or, both $R^2$ and $R^3$ together with the nitrogen atom to which they are attached, complete a fully saturated heterocyclic ring.

The solubility test procedure is as follows: 0.4g of the test precursor is mixed with 10 ml of the colour developer or bleach described in Example 1 below. The mixture is stirred for 30 seconds and held at 23° C. Five minutes after mixing a 20 μl aliquot is withdrawn, treated with cyanogeniodate to complex silver ion in solution and the silver ion present is measured by atomic adsorption spectroscopy.

Preferably the fix accelerator compounds have a solubility greater than 1 g/l in the fixer employed when tested by the above procedure wherein the fixer of Example 1 is substituted for the colour developer solution.

Representative precursor compounds useful in this invention are shown below in Table 1.

TABLE 1

1.

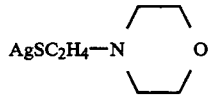

2.

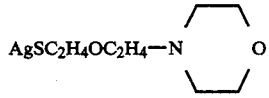

3.

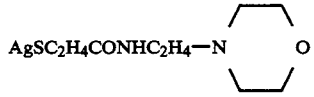

4.

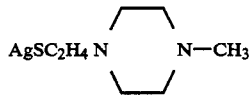

5. $AgSC_2H_4OC_2H_4N(CH_3)_2$
6. $AgSC_2H_4N(C_2H_4OCH_3)_2$
7. $Ag\ S\ C_2H_4—N(CH_3)_2$
8. $Ag\ S\ C_2H_4—NH_2$.

Compounds 1 and 4 were tested in the Solubility In Developer Test with the results 0.1 and 0.3 g/l respectively. The developer solution used was that described in Example 1 below.

One or more fix accelerator precursors of the invention can be located in the photographic element at any convenient location capable of permitting diffusion of the released active fragment to a silver containing emulsion layer during fixation. Thus the compound can be incorporated directly in the silver halide emulsion layer from which silver is to be fixed, or alternatively in any other fixer solution-permeable layer of the photographic element on either side of the support, particularly any layer adjacent the emulsion layer from which silver is to be fixed. The fixing of silver from the usually lowermost red-sensitized emulsion layer in a colour photographic element can be enhanced by incorporation of the accelerator precursor in an underlying antihalation layer.

The fix accelerator precursor compounds of the present invention can be incorporated in the photographic element by a variety of techniques. Especially preferred techniques include homogenizing or ball milling a slurry of the compound in the presence of a surfactant to form finely divided particles, as disclosed in Swank et al U.S. Pat. No. 4,006,025; milling a mixture of molten compound and a molten or liquid dispersing agent, as described in British Patent 1,151,590; or mechanically dispersing the compound, as described in Belgian Patent 852,138. Ultrasound can be employed to dissolve the compound prior to its incorporation in the photographic coating composition, as illustrated by Owen et al. U.S. Pat. No. 3,485,634 and Salminen U.S. Pat. No. 3,551,157. Alternatively, the compound can be dispersed directly in a hydrophilic colloid such as gelatin; or the compound can be loaded into a latex and dispersed, as illustrated by Chen, Research Disclosure, Vol. 159 July 1977, Item 15930.

Exemplary apparatus and procedures for introducing and blending the bleach accelerator compounds according to this invention are illustrated by Johnson et al U.S. Pat. Nos. 3,425,835; 3,570,818; 3,773,302 and 3,850,643; McCrossen et al U.S. Pat. No. 3,342,605; Collins et al U.S. Pat. No. 2,912,343 and Terwilliger et al U.S. Pat. Nos. 3,827,888 and 3,888,465.

The fix accelerator precursors are incorporated in a photographic element, such as an otherwise conventional colour photographic element, preferably at levels in the range of from 0.1 to 10 g/m$^2$, preferably from 0.5 to 5.0 g/m$^2$, with levels of from 0.5 to 2.0 g/m$^2$ being preferred for ordinarily encountered silver levels. For photographic elements having elevated silver levels higher levels of the compounds may be desirable.

The preferred fixing agent is an alkali metal thiosulphate and the fixer solution is preferably substantially free from ammonium ions. The fixer may also comprise any of the fixing agents referred to in Research Disclosure Item 308119, December 1989 published by Kenneth Mason Publications, Emsworth, Hants, United Kingdom. Preferably the fix solutions comprise 50 to 600 g/litre of sodium thiosulphate.

It is particularly advantageous to employ the present method with photographic elements comprising silver halide emulsion containing silver iodide, for example, bromoiodide and chlorobromoiodide emulsions as such emulsions take longer to fix than, say, silver chloride emulsions. Emulsions which are particularly suited to the present method are bromoiodide comprising up to 12% iodide.

In one embodiment of the present invention the photographic element is a multicolour photographic material comprising a support bearing a yellow dye image-forming unit comprised of at least one blue-sensitive silver halide emulsion layer having associated therewith at least one yellow dye-forming coupler, at least one magenta dye image-forming unit comprising at least one green-sensitive silver halide emulsion layer having associated therewith at least one magenta dye-forming coupler at least one cyan dye image-forming unit comprising at least one red-sensitive silver halide emulsion layer having associated therewith at least one cyan dye-forming coupler.

Such elements may be coated on supports and contain interlayers, e.g. scavenging interlayers, sensitising dyes, chemical sensitisers, light-absorbing or scattering materials, or other addenda as described in Research Disclosure Item 308119, December 1989 published by Kenneth Mason Publications, Emsworth, Hants, United Kingdom.

The photographic element preferably contains an antihalation layer located between the emulsion layer or layers and the support which comprises grey metallic silver or a dye which absorbs substantially uniformly throughout the visible spectrum.

The silver salt fix accelerator compounds used herein and their method of synthesis are described in European Patent Application 0 317 950 A.

The following Examples are included for a better understanding of the invention.

EXAMPLE 1

A multilayer colour negative film was coated having a speed of 400 ASA. The laydown of silver halide in the layers was cyan, 2.1 g/m$^2$, magenta, 1.8 g/m$^2$ and yellow, 0.94 g/m$^2$. A dispersion of the silver salt of morpholino ethane thiol (MET), made by adding silver nitrate to the thiol, was coated at different laydowns, along with the light absorber in the antihalation layer (AHU). The light absorber was either grey silver, coated at 0.22g/m$^2$ or the dye described below. Unexposed strips of each of these films were processed in the colour developer below for 3.25 minutes at 37.8° C. and then for 3 minutes in the Bleach below. Each strip was then fixed in a model seasoned fixer of the following formula:

| | |
|---|---|
| Seasoned Fixer | |
| sodium thiosulphate, hydrated | 250.0 g |
| sodium sulphite, anhydrous | 12.0 g |
| silver bromide | 6.76 g |
| silver iodide | 0.35 g |
| water to | 1 liter |
| pH adjusted to 6.0 | |
| Colour developer | |
| Diethylenetriaminepentacetic acid | 2.0 g |
| Sodium sulphite (anhy) | 4.25 g |
| Potassium bromide | 1.5 g |
| Hydroxylamine sulphate | 2.0 g |
| Potassium carbonate | 25.0 g |
| 4-(N-ethyl-N-2-hydroxyethyl)-2-methylphenylenediamine | 4.75 g |
| Water to | 1 liter |
| pH = 10.1 | |
| Bleach | |
| Iron (III) nitrate nonohydrate | 44.00 g |
| 1,3-propylenediaminetetraacetic acid | 36.00 g |
| Ammonium bromide | 50.00 g |
| Acetic acid (glacial) | 100.00 ml |
| Ammonia to | pH 4.75 |
| Water to | 1 liter |
| Dye | |

-continued

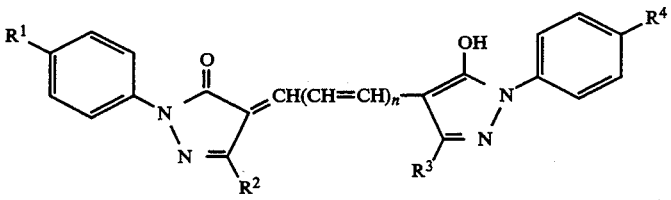

The infra-red density of the film was monitored continuously. During the fixing step agitation was carried out by nitrogen gas burst, 0.5 second every 4 seconds. The fixing time was taken as the first time when there was no further decrease in infra-red density. The results are shown in the table below.

| AgMET laydown g/m$^2$ | AHU layer | Fixing time seconds |
|---|---|---|
| 0 | silver | 200 ± 10 |
| 0.54 | silver | 190 ± 10 |
| 1.08 | silver | 140 ± 10 |
| 1.61 | silver | 110 ± 10 |
| 0.00 | dye | 170 ± 10 |
| 0.54 | dye | 160 ± 10 |
| 1.08 | dye | 130 ± 10 |
| 1.61 | dye | 110 ± 10 |

The results clearly show that the presence of the silver MET compound coated in the film accelerates fixing, with both silver and dye in the AHU as the antihalation medium.

We claim:

1. A method of fixing a photographic element with a fixer solution in which the fixing agent comprises less than 20% ammonium thiosulphate characterised in that the photographic element has incorporated therein a fix accelerator precursor which is a silver salt of an amino thiol having a solubility of less than 1 g/l (as silver ion) when held for 23° C. for 5 minutes in a colour developer solution at pH 10 having a sulphite concentration of 4.25 g/l and a bromide concentration of 1.2 g/l.

2. A method as claimed in claim 1 in which the amino thiol has a solubility of from 0.1 to 1 g/l (as silver ion).

3. A method as claimed in claim 1 in which the silver salt of the amino thiol has the general formula:

$$Ag—S—R^1—NR^2R^3$$

wherein $R^1$ is an alkylene group of 1–20 carbon atoms, $R^2$ and $R^3$ are each hydrogen or an alkyl group of 1–4 carbon atoms which may be interrupted by a hereto atom or, both $R^2$ and $R^3$ together with the nitrogen atom to which they are attached, complete a fully saturated heterocyclic ring.

4. A method as claimed in claim 3 in which $R^1$ is an alkylene group of 1–4 carbon atoms.

5. A method as claimed in claim 4 in which the silver salt of the amino thiol has one of the formulae:

1.

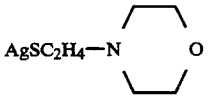

-continued

2.

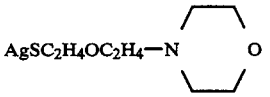

3.

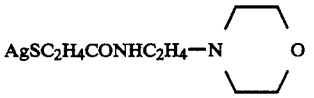

4.

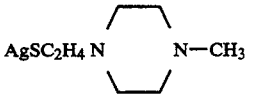

5. $AgSC_2H_4OC_2H_4N(CH_3)_2$
6. $AgSC_2H_4N(C_2H_4OCH_3)_2$
7. $Ag\ S\ C_2H_4—N(CH_3)_2$
8. $Ag\ S\ C_2H_4—NH_2$.

6. A method as claimed in claim 1 in which the fix accelerator compound is incorporated in a silver halide emulsion layer or in any other fixer solution-permeable layer.

7. A method as claimed in claim 1 in which the fix accelerator compound is incorporated in a layer between the emulsion layer or layers and the support.

8. A method as claimed in claim 1 in which the fix accelerator compound is incorporated in an amount of from 0.01 to 10 g/m$^2$.

9. A method as claimed in claim 1 in which the fix accelerator compound is incorporated in an amount of from 0.5 to 2.0 g/m$^2$.

10. A method as claimed in claim 1 in which the emulsion layer or layers comprise silver bromoiodide containing up to 12% silver iodide.

11. A method as claimed in claim 1 in which the photographic element is a multicolour photographic material comprising a support bearing a yellow dye image-forming unit comprised of at least one blue-sensitive silver halide emulsion layer having associated therewith at least one yellow dye-forming coupler, at least one magenta dye image-forming unit comprising at least one green-sensitive silver halide emulsion layer having associated therewith at least one magenta dye-forming coupler at least one cyan dye image-forming unit comprising at least one red-sensitive silver halide emulsion layer having associated therewith at least one cyan dye-forming coupler.

12. A method as claimed in claim 1 in which the photographic element contains an antihalation layer located between the emulsion layer or layers and the support which comprises grey metallic silver or a dye which absorbs substantially uniformly throughout the visible spectrum.

13. A method as claimed in claim 1 in which the fix accelerator compound is incorporated in an amount of from 0.5 to 5.0 g/m$^2$.

* * * * *

UNITED STATES PATENT AND TRADEMARK OFFICE

CERTIFICATE OF CORRECTION

PATENT NO. : 5,389,501

DATED : Feb. 14, 1995

INVENTOR(S) : Rogers et al

It is certified that error appears in the above-indentified patent and that said Letters Patent is hereby corrected as shown below:

Col. 5, line 57 delete "hereto" and replace with

-- hetero --.

Signed and Sealed this

Eleventh Day of April, 1995

Bruce Lehman

*Attest:*

BRUCE LEHMAN

*Attesting Officer*

*Commissioner of Patents and Trademarks*